US006438853B1

(12) United States Patent
Gordon et al.

(10) Patent No.: US 6,438,853 B1
(45) Date of Patent: Aug. 27, 2002

(54) SET OF HUMAN TORSO MANIKINS FOR USE IN FABRICATION AND EVALUATION OF BODY WEAR FOR A GROUP OF HUMAN BEINGS

(75) Inventors: Claire Catherine Gordon, Sutton; J. David Brantley, Natick; Brian D. Corner, Ashland; Steven P. Paquette, Framingham, all of MA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/617,927

(22) Filed: Jul. 17, 2000

Related U.S. Application Data

(60) Provisional application No. 60/150,870, filed on Aug. 26, 1999.

(51) Int. Cl.[7] ..... G01B 3/14; A41H 3/04

(52) U.S. Cl. ..... 33/2 R; 33/11; 33/17 R; 33/512; 33/562; 33/565; 223/66

(58) Field of Search ..... 33/2 R, 11, 17 R, 33/512, 562, 565; 223/66

(56) References Cited

U.S. PATENT DOCUMENTS 3,769,134 A * 10/1973 Livingston ..... 156/293
3,810,565 A * 5/1974 Livingston ..... 223/68
4,136,557 A * 1/1979 Bell, Jr. et al. ..... 33/2 A
4,734,039 A * 3/1988 Thompson ..... 434/274
4,885,844 A 12/1989 Chun ..... 33/15
5,680,528 A 10/1997 Korzun ..... 395/135
5,970,789 A * 10/1999 Meyer et al. ..... 73/172

OTHER PUBLICATIONS

Claire C. Gordon et al, Defining Extreme Sizes and Shapes for Body Armour and Load–Bearing Systems Design, 1997.
Claire C. Gordon, Anthropometric Requirements for Body Armour and Load Carriage Systems, 1998.

* cited by examiner

*Primary Examiner*—Randy W. Gibson
(74) *Attorney, Agent, or Firm*—Vincent J. Ranucci

(57) ABSTRACT

A set of human torso manikins for use in fabrication and evaluation of body wear for a group of human beings, the torso manikins being shaped and dimensioned to conform to selected parameters derived from statistical analysis of the group. The manikins include a central human torso manikin of a shape corresponding to a multivariate center of anthropometric distributions of selected members of the group, and a plurality of extreme human torso form manikins each of a shape corresponding to a multivariate extreme suitable for accommodation of 90% of the group. About half of the plurality of extreme human torso form manikins exhibits a dimensional specification substantially less than a corresponding specification of the central human torso manikin and about another half of the plurality of extreme human torso form manikins exhibits a dimensional specification substantially greater than the corresponding specification of the central human torso manikin.

11 Claims, 7 Drawing Sheets

MALE FORM A (largest overall)

| | Dimension | Inches |
|---|---|---|
| 1 | chest circ @scye | 45 5/8 |
| 2 | bust/chest circ | 44 7/8 |
| 2a | below cervicale @ | 10 1/2 |
| 3 | shoulder circ | 50 7/8 |
| 4 | vertical trunk circ | 68 5/8 |
| 5 | natural indent circ | 38 1/4 |
| 5a | above waist (naval) @ | 3 1/2 |
| 6 | waist circ (at naval) | 41 1/4 |
| 7 | hip circ | 43 3/4 |
| 7a | below waist (naval) @ | 7 |
| 8 | waist back length | 20 1/8 |
| 9 | waist front length | 17 1/2 |
| 10 | across back | 17 |
| 10a | below cervicale @ | 4 1/2 |
| 11 | across back at scye | 17 1/2 |
| 11a | below cervicale @ | 9 |
| 12 | shoulder length | 6 1/8 |
| 13 | diaphram under bust | 41 3/4 |
| 14 | bust around neck | 31 1/4 |
| 15 | neck circ, base | 17 1/4 |
| 16 | crotch length (navel) | 27 3/4 |
| 17 | shoulder breadth | 16 3/8 |
| 18 | chest breadth | 14 3/4 |
| 19 | neck circ, top of form | 16 1/4 |
| 20 | arm scye circ | 19 1/4 |
| 21 | axillary arm circ | 14 3/4 |
| 22 | NO DATA | |
| 23 | shoulder to end of arm | 7 1/2 |
| 24 | thigh circ at gluteal furrow | 27 1/2 |
| 25 | thigh at bottom of form | 17 3/8 |
| 26 | crotch to end of thigh | 12 7/8 |

*FIG. 11*

SET OF HUMAN TORSO MANIKINS FOR USE IN FABRICATION AND EVALUATION OF BODY WEAR FOR A GROUP OF HUMAN BEINGS

CROSS-REFERENCE TO RELATED APPLICATION

This application claims the benefit of U.S. Provisional Application Ser. No. 60/150,870 filed on Aug. 26, 1999 in the name of Claire Catherine Gordon et al.

STATEMENT OF GOVERNMENT INTEREST

The invention described herein may be manufactured, used and licensed by or for the U.S. Government for Governmental purposes without the payment of any royalties thereon.

BACKGROUND OF THE INVENTION

1. Field of the Invention

The invention relates to manikins for use in fabrication and evaluation of body wear and is directed more particularly to a set of manikins for use in fabrication of body wear for U.S. Army soldiers, and other selected groups of human beings.

2. Description of the Prior Art

Commercially available manikins have body dimensions that represent idealized body shapes for fashionable purposes, rather than actual body shapes of groups of real people, such as soldiers. There are no commercially available manikins with body dimensions at the center of Army anthropometric distributions. This means that initial combat clothing and equipment prototypes are not developed over realistic body shapes, and that these size "medium" prototypes are not in the actual center of the user distribution. Further, there are no commercially available manikins with body dimensions and shapes that correspond to the anthropometric limits of a 90% "off-the shelf" sizing requirement. Initial testing of the accommodation rates for prototype sizing systems often does not occur until late in the developmental cycle, when sizing corrections are costly and time consuming to implement.

Anthropometric data defining the center and periphery of Army body size distributions have been published as tables of numbers in technical reports, but such data is virtually unusable by engineers and designers who require solid models for their work.

Accordingly, there is a need for manikins which facilitate standardizing the sizing and design of combat clothing master patterns over a common anthropometrically accurate form, and which standardize the anthropometric limits corresponding to a 90% accommodation requirement for Army personnel.

SUMMARY OF THE INVENTION

An object of the invention is, therefore, to provide central forms which, provide realistic "average" soldiers that center sizing systems and provide accurate body proportions for multicomponent integration of combat systems, thereby improving both efficiency and accuracy of sizing systems. A further object of the invention is to provide extreme forms which provide opportunities to check the ability of sizing systems to accommodate a full range of body sizes and shapes, required early in a developmental cycle, and without recourse to expensive human subject testing, and avoiding costly human factor failures late in developmental cycles.

A still further object of the invention is to provide statistical data describing the central and extremes of the body size distribution rendered in a physical form that is familiar and useful to clothing designers and engineers, to ensure that sophisticated mathematical solutions to sizing and design optimization are transitioned to end item developers in a medium that facilitates their use in everyday product development.

With the above and other objects in view, as will hereinafter appear, a feature of the present invention is the provision of a set of human torso manikins for use in fabrication and evaluation of body wear for a group of human beings, the torso manikins being shaped and dimensioned to conform to selected parameters derived from statistical analysis of the group. The set comprises a central human torso manikin of a shape corresponding to a multivariate center of anthropometric distributions of selected members of the group, and a plurality of extreme human torso form manikins, each of a shape corresponding to a multivariate extreme suitable for accommodation of 90% of the group. About half of the plurality of extreme human torso form manikins exhibits a dimensional specification substantially less than a corresponding specification of the central human torso manikins and about another half of the plurality of extreme human torso form manikins exhibits a dimensional specification substantially greater than the corresponding specification of the central human torso manikin.

The above and other features of the invention, including various novel details of construction and combinations of parts, will now be more particularly described with reference to the accompanying drawings and pointed out in the claims. It will be understood that the particular devices embodying the invention are described by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings:

FIG. 11 is a chart produced by the measurements illustrated in FIGS. 5–10, the chart and similar charts providing data from which the shapes and dimensions of the manikins of FIGS. 1–4 are determined.

DESCRIPTION OF THE PREFERRED EMBODIMENT

Figure 1:
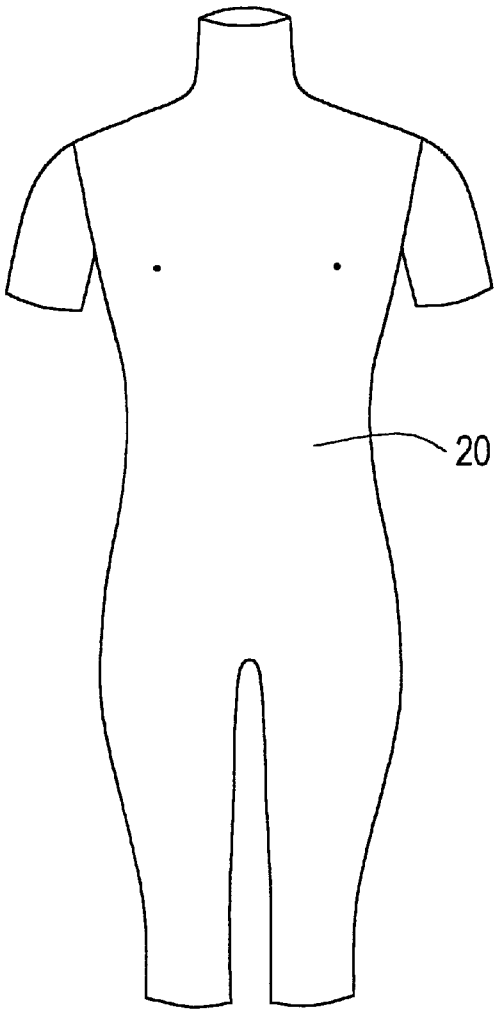
FIG. 1 is a front elevational view of a central form portion of a set of manikins illustrative of an embodiment of the invention for male humans.
Figure 2:
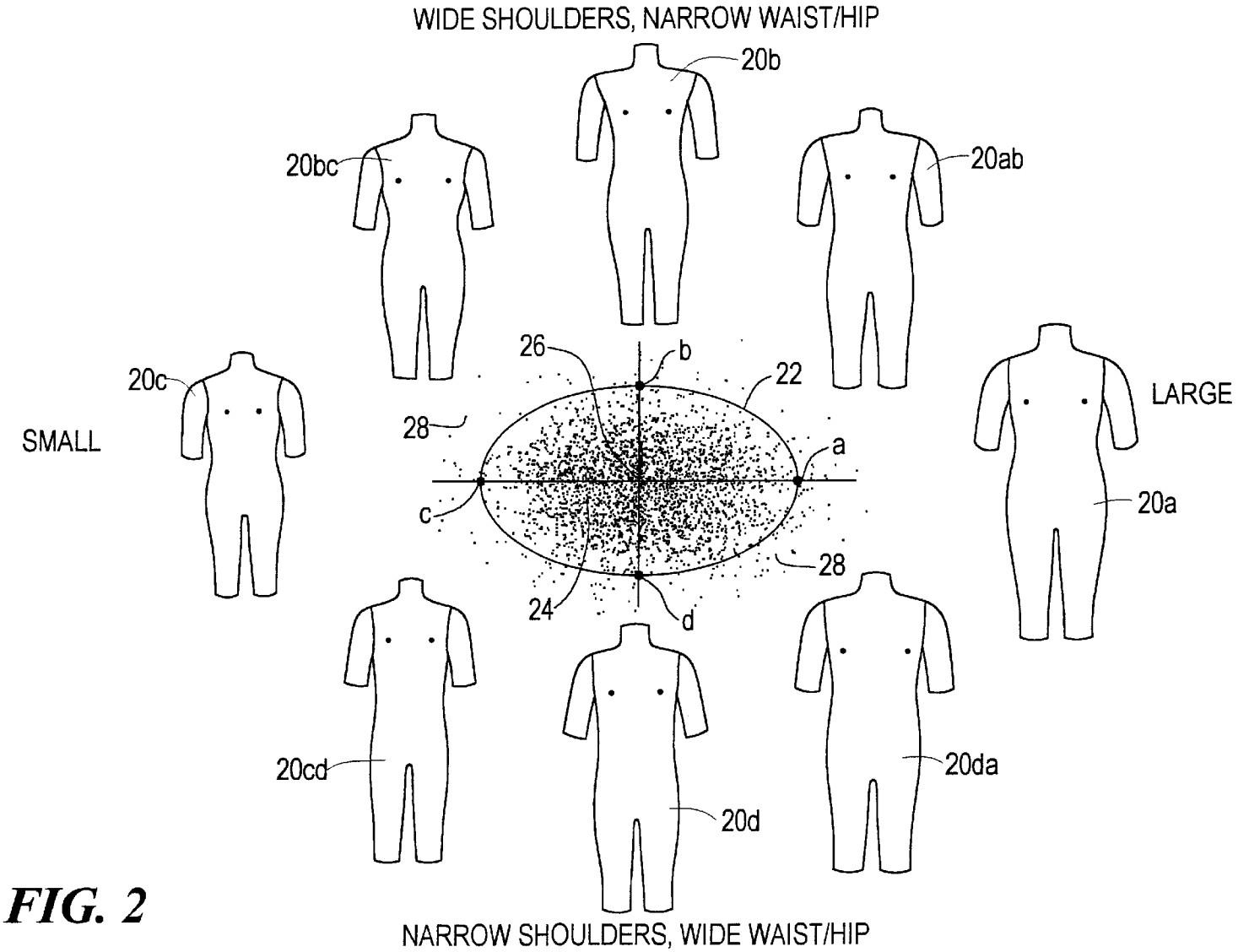
FIG. 2 is a chart illustrating further manikins in the set of male manikins, the further manikins being shown in front elevational views.

Referring to FIGS. 1 and 2, it will be seen that an illustrative set of manikins includes a "central" manikin 20 and eight "extreme" manikins 20*a*, 20*ab*, 20*b*, 20*bc*, 20*c*, 20*cd*, 20*d* and 20*da*.

The manikins 20–20*da* are shaped and dimensioned according to data taken from male humans of the type for which body wear is intended. For example, thousands of U.S. Army male soldiers were measured along parameters illustrated in FIGS. 5–10. Tables of data were produced. One such table is illustrated in FIG. 11. The central manikin 20, shown in FIG. 1, is made in accordance with the data presented in a chart (not shown) similar to the chart depicted in FIG. 11, the data representing the average physical parameters of all the measured army male soldiers. Clothing or armor, or the like, made to fit manikins 20 would fit the "average" male soldier.

Referring again to FIG. 2, in addition to the manikins 20*a*–20*da*, there is depicted an ellipse 22 which encloses a multitude of dots 24. Each dot 24 represents one of the measured male soldiers and the location of the dot 24 indicates spatially where that soldier falls in a plot of data representing other measured soldiers. Most of the dots are disposed proximate a center 26 of the ellipse 22. A few dots 28, about 10% of the total dots, fall outside the ellipse 22. The dimensions of the ellipse are determined such that 1) 90% of the dots fall inside the ellipse, and 2) the ellipse is centered over the dot distribution. The central form 20 (FIG. 1) manifests in hardware the center 26 of the ellipse 22. A point a on the ellipse represents data from which is generated the manikin 20*a*, which manifests in hardware the largest male soldier within the 90% boundary. Similarly, a point c on the ellipse represents data from which is generated the manikin 20*c*, which manifests in hardware the smallest male soldier within the 90% boundary. A point b on the ellipse 22 represents data from which is generated the manikin 20*b*, which manifests in hardware the most extreme combination of wide shoulders and narrow waist/hip within the 90% boundary. Similarly, the manikin 20*d* is configured and dimensionalized between manikins 20*a* and 20*c* and represents the most extreme combination of narrow shoulders and wide waist/hip within the 90% boundary.

In a similar manner, manikin 20*ab* results from data between the data producing manikins 20*a* and 20*b*, manikin 20*bc* from data between the data producing manikins 20*b* and 20*c*, manikin 20*cd* from data between the data producing manikins 20*c* and 20*d*, and the manikin da from data between the data producing manikins 20*d* and 20*a*.

For each of the manikins 20 and 20*a*–20*da* there is first developed a table of data, as illustrated in FIG. 11, which is illustrative of all the tables, but which is specifically for the manikin 20*a*, the largest over-all manikin. The largest over-all manikin 20*a* results from the data represented by the point a on the ellipse. That is, aside from about 10% of the group of Army males measured, the manikin 20*a* is the "extreme" large size. Similarly, the other extreme manikins exhibit extreme proportions which appear, statistically, at the points ab, b, bc, c, cd, d and da on the ellipse 22.

Figure 4:
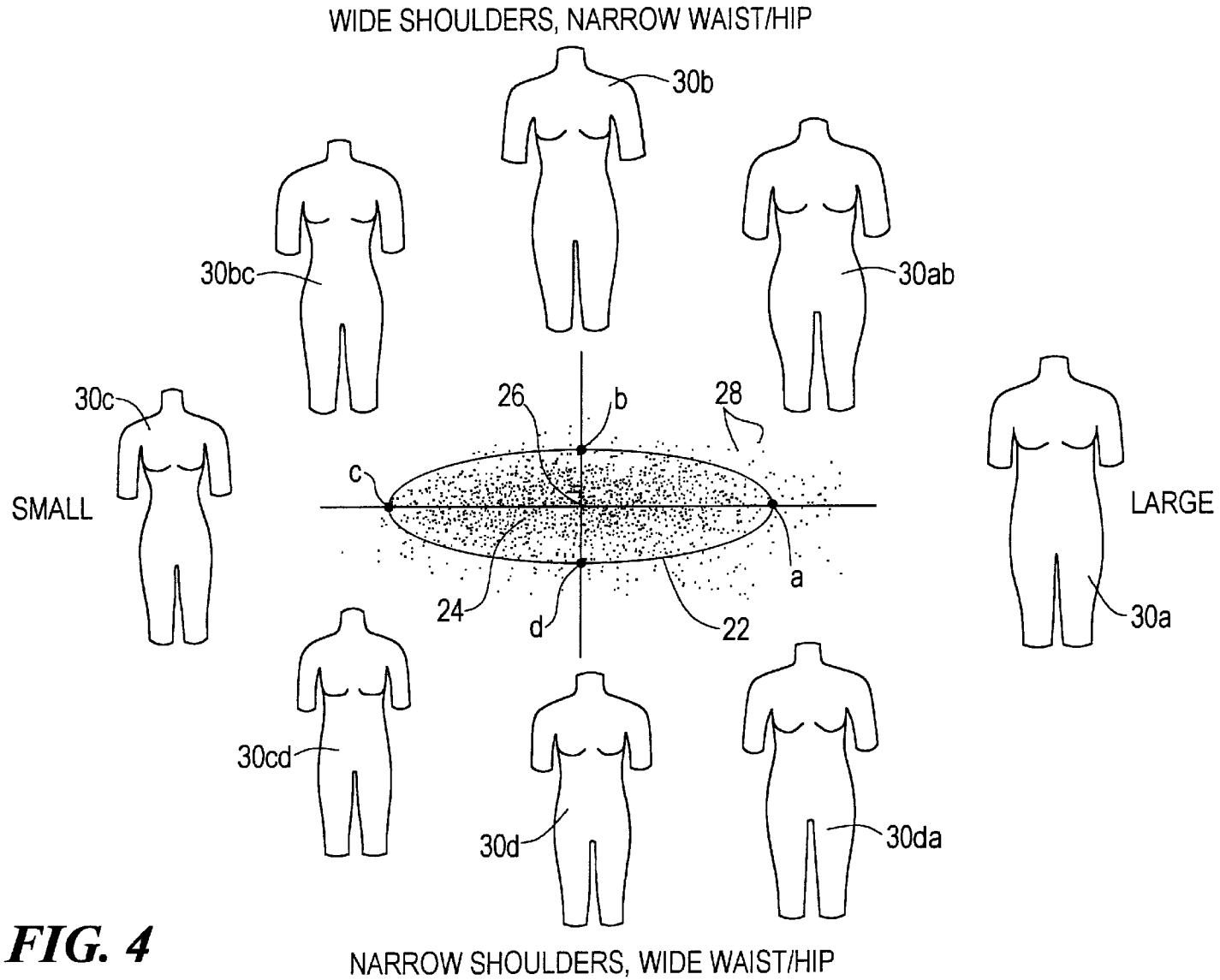
FIG. 4 is similar to FIG. 2 but illustrative of further manikins in the set of female manikins.
Figure 5:
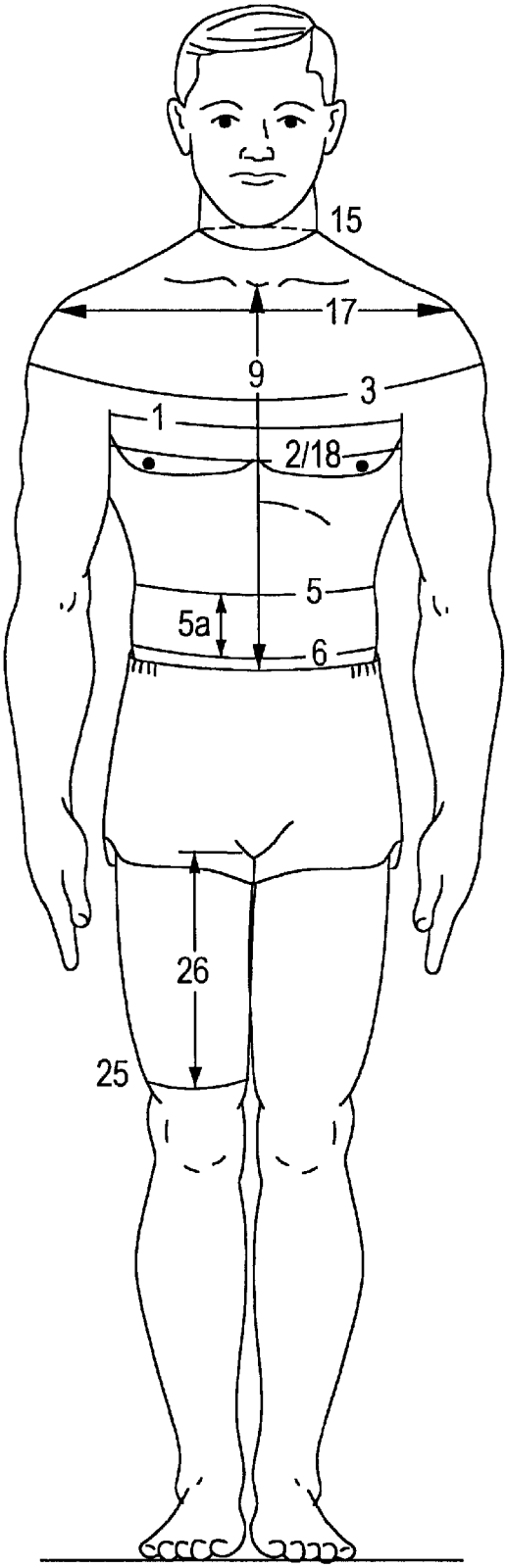
FIGS. 5–10 are elevational views of a male with illustrated measurements used to produce data used to determine shapes and dimensions of the sets of manikins.
Figure 6:
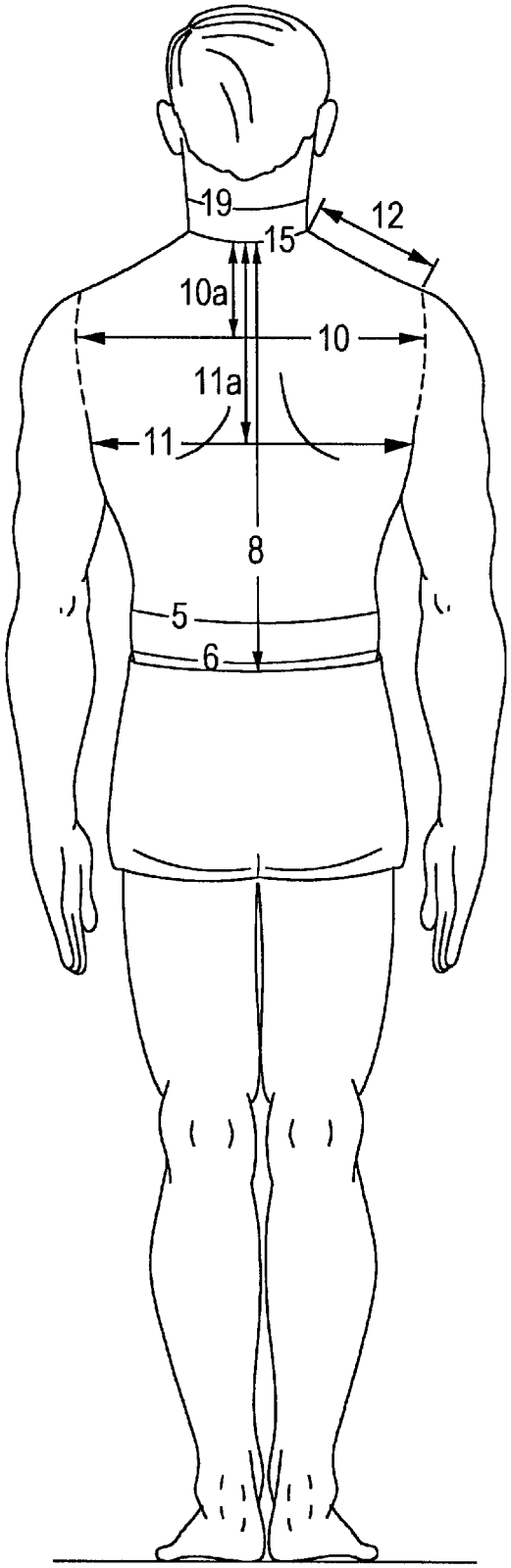
Figure 7:
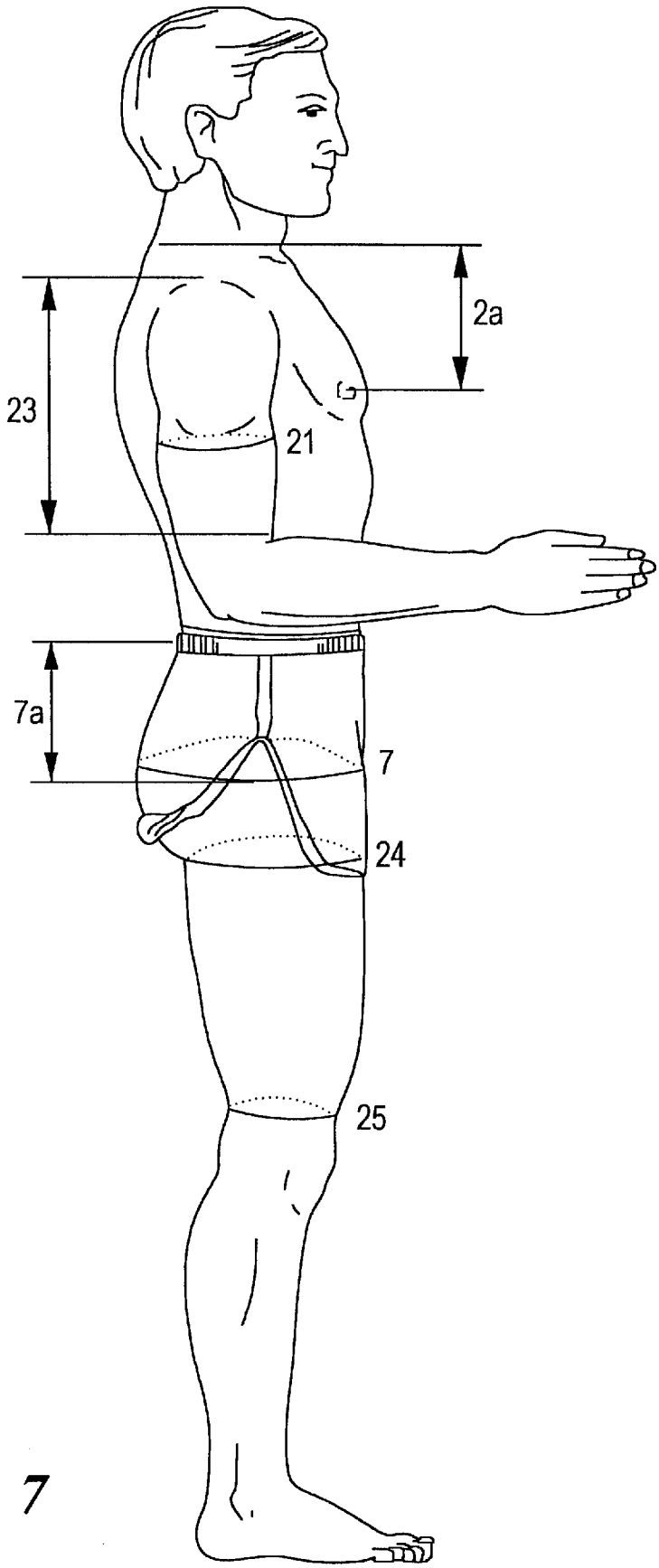
Figure 10:
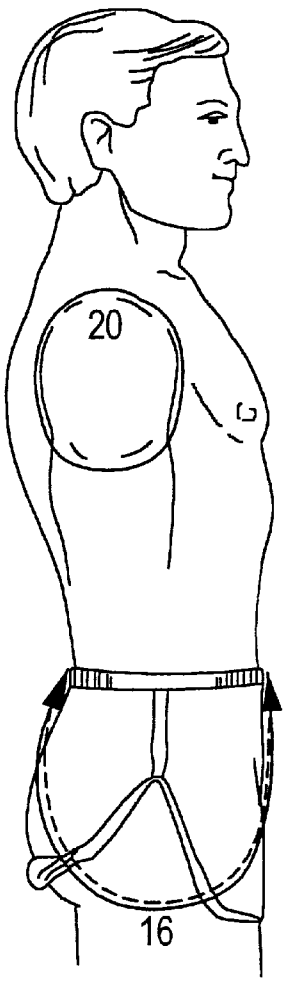
Figure 9:
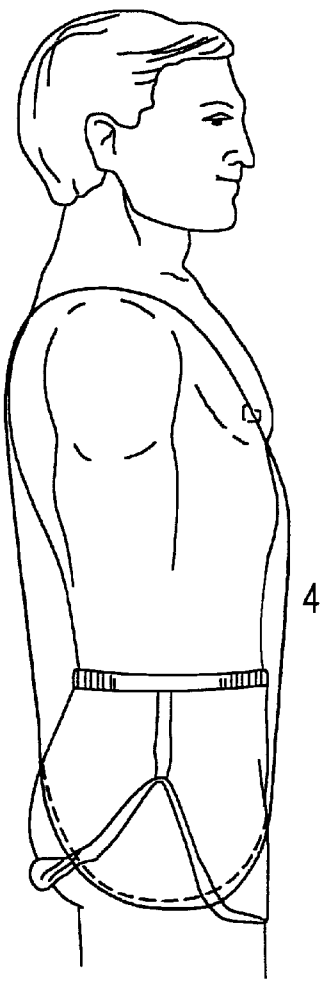
Figure 8:
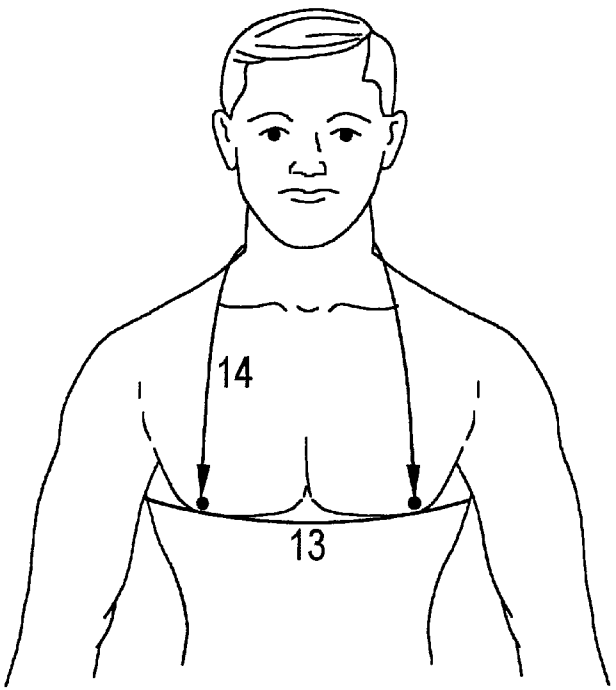

The statistical approach for determination of the various forms includes selection of dimensions relevant to design and sizing of the body wear concerned, execution of a principal component analysis on the convergence matrix of those dimensions, scoring each subject on the first two principal components, and plotting the measured population, as in the ellipse configuration shown in FIGS. 2 and 4, and identifying extreme cases located on the surface of the ellipse and a centrally located multivariate average model when the component axes cross, all as disclosed in detail in "Defining Extreme Sizes and Shapes for Body Armor and Load-Bearing Systems Design" by Claire C. Gordon, Brian D. Corner and J. David Brantley, a Report of March 1997 for the U.S. Army Soldier Systems Command, Natick RD&E Center, Natick Mass., and further in a paper entitled "Anthropometric Requirements for Body Armor and Load Carrying Systems" by Claire C. Gordon of the U.S. Army Natick R, D & E Center, presented at the 1998 meeting of the Human Factors and Ergonomics Society, Chicago, Ill., both of which are incorporated herein by reference.

The set of manikins shown in FIGS. 1 and 2 provide the types of forms with which clothing manufacturers and designers are used to working. However, the forms, as a group, represent the central and extreme body sizes and shapes that must be accommodated when the clothing is designed and made, to ensure that the clothing will fit 90% of Army personnel.

In use, a designer of, for example, body armor, may develop a design in a selected material right on the central manikin 20. When an appropriate fit is settled upon for the manikin 20, the designer can then test on extreme manikins how the armor would fit. Depending upon the results of the attempted fit, decisions can be made as to whether a "one size fits all" approach is feasible and, if not, how many sizes are required to fit 90% of the army personnel.

Figure 3:
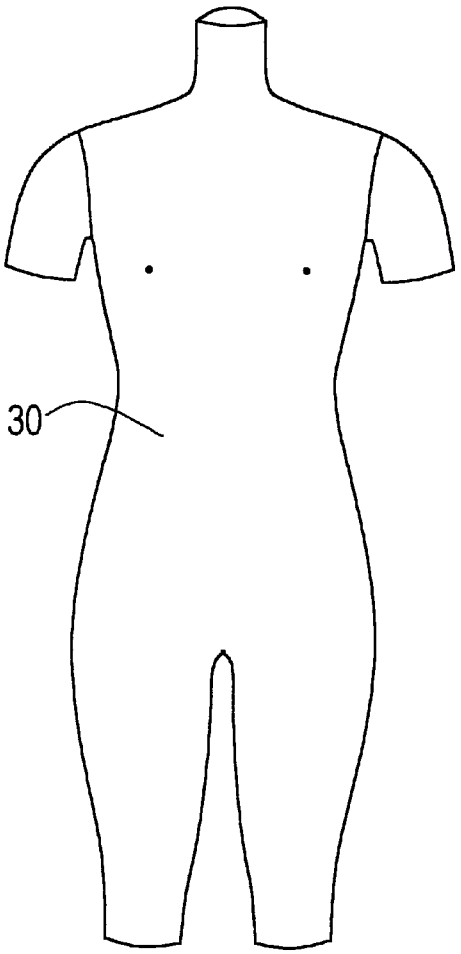
FIG. 3 is a front elevational view of a central form portion of a set of manikins illustrative of an alternative embodiment of the invention for female humans.

Referring to FIG. 3, it will be seen that a central female manikin 30 may be provided in the same manner, along with "extreme" female manikins, shown in FIG. 4.

The above description relative to the set of male manikins applies as well to the set of female manikins 30–30*da*. Measurements are taken from a multiplicity of female army personnel to generate data from which tables, similar to that shown in FIG. 11, are produced. Based upon the data in the tables, the manikins 30–30*da* are produced. The ellipse 22 for the female personnel is configured somewhat differently from the ellipse for males because the variance in shoulder and waist/hip proportions among female soldiers is less than the variance in shoulder and waist/hip proportions among male soldiers. Accordingly, points b and d are closer to each other for females than for males.

It is to be understood that the present invention is by no means limited to the particular construction herein disclosed and/or shown in the drawings, but also comprises any modification or equivalent within the scope of the claims. For example, the above description has been presented in the context of fabrication of body wear for Army personnel. It will be apparent, however, that the manikin sets described herein apply to similar groups of humans and to young, physically fit Americans generally. It will be further apparent that the database of statistical parameters may be generated for any group out of the main-stream of population anthropometry, such as, for example, professional basketball players and dwarfs. It will be still further apparent that the number of manikins in a set is a matter of selection. While a set of nine appears to serve the needs of the U.S. Army, for some non-military purposes a central manikin and four extreme manikins, such as forms 20*a*, 20*b*, 20*c* and 20*d*, may well serve the purpose.

What is claimed is:

1. A set of human torso manikins for use in fabrication and evaluation of body wear for a group of human beings, the torso manikins being shaped and dimensioned to conform to selected parameters derived from statistical analysis of the group, the set comprising:

a central human torso manikin of a shape corresponding to a multivariate center of anthropometric distributions of selected members of the group; and a plurality of extreme human torso form manikins each of a shape corresponding to a multivariate extreme suitable for accommodation of 90% of the group;

wherein about half of said plurality of extreme human torso form manikins exhibits a dimensional specification substantially less than a corresponding specification of said central human torso manikins and about another half of said plurality of extreme human torso form manikins exhibits a dimensional specification substantially greater than the corresponding specification of said central human torso manikin.

2. The set of human torso manikins in accordance with claim 1 wherein said group of human beings comprises male human beings and said central human torso manikin exhibits body dimensions, shape and proportions arrived at through multivariate statistical analysis of an anthropometric database of males in said group to provide an average male torso manikin for the group.

3. The set of human torso manikins in accordance with claim 1 wherein said group of human beings comprises female human beings and said central human torso manikin exhibits body dimensions, shape and proportions arrived at through multivariate statistical analysis of an anthropometric database of females in said group to provide an average female torso manikin for the group.

4. The set of human torso manikins in accordance with claim 2 wherein said plurality of extreme human torso form manikins each is of a shape corresponding to a multivariate extreme suitable for accommodation of 90% of the males in said group.

5. The set of human torso manikins in accordance with claim 3 wherein said plurality of extreme human torso form manikins each is of a shape corresponding to a multivariate extreme suitable for accommodation of 90% of the females in said group.

6. The set of human torso manikins in accordance with claim 5 wherein said set of manikins comprises nine manikins.

7. The set of human torso manikins in accordance with claim 1 wherein the statistical analysis is based on a U.S. Army Anthropometric Database.

8. The set of human torso manikins in accordance with claim 7 wherein said parameters comprise a multiplicity of statistical parameters from the U.S. Army Anthropometric Database.

9. The set of human torso manikins in accordance with claim 8 wherein said group comprises U.S. Army soldiers.

10. The set of human torso manikins in accordance with claim 8 wherein the multiplicity of statistical parameters comprises about 30 statistical parameters.

11. The set of human torso manikins in accordance with claim 9 wherein said central human torso manikin comprises a torso of substantially average size with average body proportions computed from the multiplicity of statistical parameters of the Database.

* * * * *